US006666116B1

(12) United States Patent
Marks

(10) Patent No.: US 6,666,116 B1
(45) Date of Patent: Dec. 23, 2003

(54) SELF-SUPPORTING RETAINING DEVICE FOR THREADED FASTENER ASSEMBLY

(75) Inventor: Charles C. Marks, Springfield, OH (US)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/033,231

(22) Filed: Dec. 28, 2001

(51) Int. Cl.[7] ..... B25B 23/00
(52) U.S. Cl. ..... 81/462; 81/13; 81/55
(58) Field of Search ..... 81/462, 44, 13, 81/55, 487

(56) References Cited

U.S. PATENT DOCUMENTS

| | | | | | |
|---|---|---|---|---|---|
| 1,338,549 | A | * | 4/1920 | Banta | 81/55 |
| 2,202,895 | A | * | 6/1940 | Brinton | 81/13 |
| 2,468,983 | A | * | 5/1949 | Johnson | 81/13 |
| 3,837,244 | A | | 9/1974 | Schera, Jr. | 81/64 |
| 4,121,444 | A | | 10/1978 | Duran | 72/114 |
| 4,364,288 | A | * | 12/1982 | Castoe | 81/55 |
| 4,573,378 | A | | 3/1986 | McDonald | 81/463 |
| 4,606,246 | A | | 8/1986 | Gunther | 81/58.3 |
| 4,875,395 | A | * | 10/1989 | Alvarez | 81/13 |
| 4,920,835 | A | * | 5/1990 | Hendricks | 81/13 |
| 5,692,789 | A | | 12/1997 | Woodsum | 294/19.1 |
| 6,038,754 | A | | 3/2000 | Stafford | 29/267 |
| 6,260,450 | B1 | | 7/2001 | Ragsdale, Jr. et al. | 81/121.1 |

OTHER PUBLICATIONS

"Snap–On" Product Catalog 2000, p. E56, product H, Snap–On Tools Company, Kenosha, Wisconsin.

* cited by examiner

*Primary Examiner*—D. S. Meislin
(74) *Attorney, Agent, or Firm*—Standley Law Group LLP

(57) ABSTRACT

A self-supporting retaining device for retaining the head or nut of a threaded fastener assembly. A first portion of the device has a retaining component, such as a socket, for engaging the head or nut. A second portion of the device is adapted to engage a structure or feature that neighbors the location of the fastener assembly. Once the retaining component is mated to the head or nut of the fastener assembly, the second portion of the device is releasably engaged with the neighboring structure. The engagement of the second portion with the neighboring structure permits the position of the device to be independently maintained. The retaining component retains the associated head or nut, thereby allowing a user of the device to tighten or loosen the fastener assembly by manipulating only the head or nut located at the opposite end thereof. The device may then be disengaged from the fastener assembly and neighboring structure.

19 Claims, 7 Drawing Sheets

SELF-SUPPORTING RETAINING DEVICE FOR THREADED FASTENER ASSEMBLY

BACKGROUND AND SUMMARY OF THE INVENTION

The present invention involves a device for retaining the position of a nut or head of a threaded fastener assembly during the tightening or loosening thereof. The device can be mated to the nut or head of the fastener assembly and released, wherein it will thereafter support itself and retain the nut or head, allowing the user of the device to use both hands to manipulate the nut or head on the opposite end of the fastener assembly.

In fastening operations, especially in fastening operations utilizing a threaded fastener assembly such as a bolt and nut, the position of the fastener assembly often is not conducive to proper ergonomic manipulation by a user thereof. For example, when using a bolt and nut, the length of the bolt may make it difficult for a user to simultaneously reach both the bolt head and the nut attached to the threaded end of the bolt. It is also possible, due to the structure through which the bolt passes, that one or both of the bolt head and the nut may be obstructed from the view of the user. This can result in the user blindly searching for either the bolt head or the nut, such as by feeling for one or the other. In such situations, it is not only difficult for the user to comfortably and safely perform a fastening or loosening operation, but it may even be difficult for the user to engage either the bolt head or nut of the fastener assembly with the proper tools.

It is also possible when using a double-ended fastener, such as a bolt and nut, that the user may be required to observe the position of either the bolt head or the nut. For example, the bolt head may have a marking or other position indicator that is required to be aligned with some other feature of the structure through which the bolt passes. Similarly, it may be necessary to observe the nut during the fastening or loosening operation. If the bolt head and nut are either spaced at too great a distance, the view thereof is obstructed, or both, the user may not be able to properly manipulate the fastener assembly. For example, if the bolt head and nut are spaced at too great a distance, the user may not be able to observe the bolt head while maintaining the position of the nut. Similarly, if the view of the bolt head and/or the fastener is obstructed by some other structure, it may be necessary to observe both the bolt head and the nut while fitting a tool thereto. However, when both the bolt head and the nut cannot be viewed simultaneously, it may not be possible to maintain control over each tool that must be used to manipulate the fastener assembly. Hence, it can be seen that situations may occur wherein a user cannot physically simultaneously operate both a tool engaged with the bolt head and a tool engaged with the nut of the fastener assembly.

What is needed then, is a device for maintaining the position of a nut or bolt head without continuing physical contact by the user. Available tools are not designed to engage a bolt head or nut without user interaction. It is true that a wrench or socket may in certain situations remain engaged with a bolt head or nut after release by a user thereof. However, it is difficult, if not impossible in most situations for the wrench or socket to secure the position of the bolt head or nut, while also remaining engaged therewith as the fastener assembly is tightened or loosened. Typically, any tool that is left unrestrained on a bolt head or nut will rotate along with the bolt head or nut as the fastener assembly is rotated by the user. Thus, any tool left unrestrained on a bolt head or nut will also likely become dislodged upon contact with a neighboring structure. Consequently, it is desirable to have a device that may be placed into self-supporting and mating engagement with either a bolt head or a nut, such that the device is able to maintain its position and restrain the bolt head or nut without user interaction.

The present invention is designed to perform such a function. The present invention comprises a device having a first portion that can be placed into mating engagement with either the bolt head or nut of a threaded bolt-type fastener assembly. The device also has a second portion that is adapted to engage a structure that neighbors the component or components to which the fastener assembly is installed. The second portion is preferably extendable or retractable to allow it to properly communicate with the neighboring structure. The second portion is also preferably biased toward either an extended or retracted position, such that after the second portion is placed into proper contact with the structure, the device will independently remain in the installed (mated) position on the bolt head or nut. Once the device is installed, the bolt head or nut on the opposite end of the fastener assembly may be rotated by the user. Because the device is able to independently retain the position of the bolt head or nut to which it is installed, tightening or loosening of the fastener assembly may be accomplished by manipulating only the bolt head or nut on the opposite end thereof (i.e., there is no need for the user to maintain the position of the bolt head with a first tool while simultaneously tightening the nut with a second tool).

Preferably, the device employs a socket component on the first portion for engaging and retaining the particular fastener assembly element. The socket component may be permanently affixed to the first portion, such as by welding. Alternatively, the socket component may be attached to the first portion by means of a typical socket retaining post. Such structures are commonly utilized on ratcheting socket wrenches to allow the releasable connection of various sockets. In this manner, the device may be used on bolts having a multitude of bolt head and nut sizes. In lieu of the socket component, the device may also employ an open-end or box wrench component to engage and retain the bolt head or nut.

To use the device, for example, to secure the position of a bolt head during the tightening of a nut element of a fastener assembly, the user first places the socket component over the bolt head. The second portion of the device may then be extended (or retracted) as necessary to initially clear the neighboring structure with which it will engage. The device may then be rotated by turning the device and the loose bolt head. The second portion may then be released, whereby a biasing means will encourage the second portion toward its natural position. A protruding leg or other structure on the second portion is preferably provided to engage with the structure, such that the position of the device will be maintained and the device will be prevented from rotating. The user may then proceed to tighten the fastener assembly by rotating the nut with the proper tool. After tightening is completed, the second portion of the device may again be extended (or retracted) to provide adequate clearance for withdrawal of the socket from the bolt head, and the subsequent removal of the device.

The device of the present invention may be used in virtually any situation wherein a threaded fastener assembly having a bolt head and nut, or a combination of nuts, is used in sufficient proximity to an adjacent structure with which the device can make contact. In one particular application, the present device can be used to assist in securing a substantially hidden fastener assembly used in the rear suspension of an automobile.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF THE EXEMPLARY EMBODIMENT(S)

Figure 1:
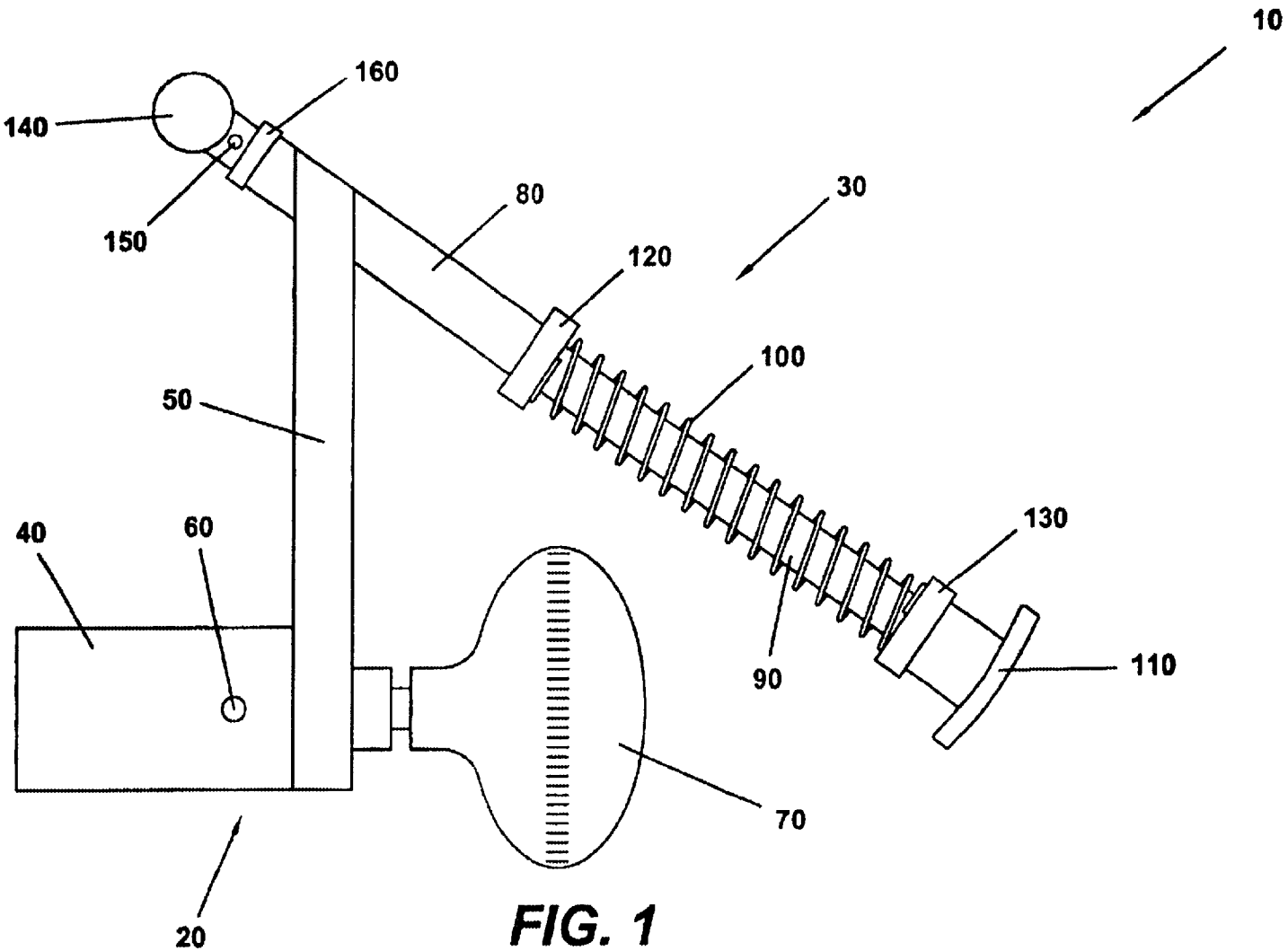
FIG. 1 is a top plan view of one embodiment of a self-supporting retaining device of the present invention.
Figure 2:
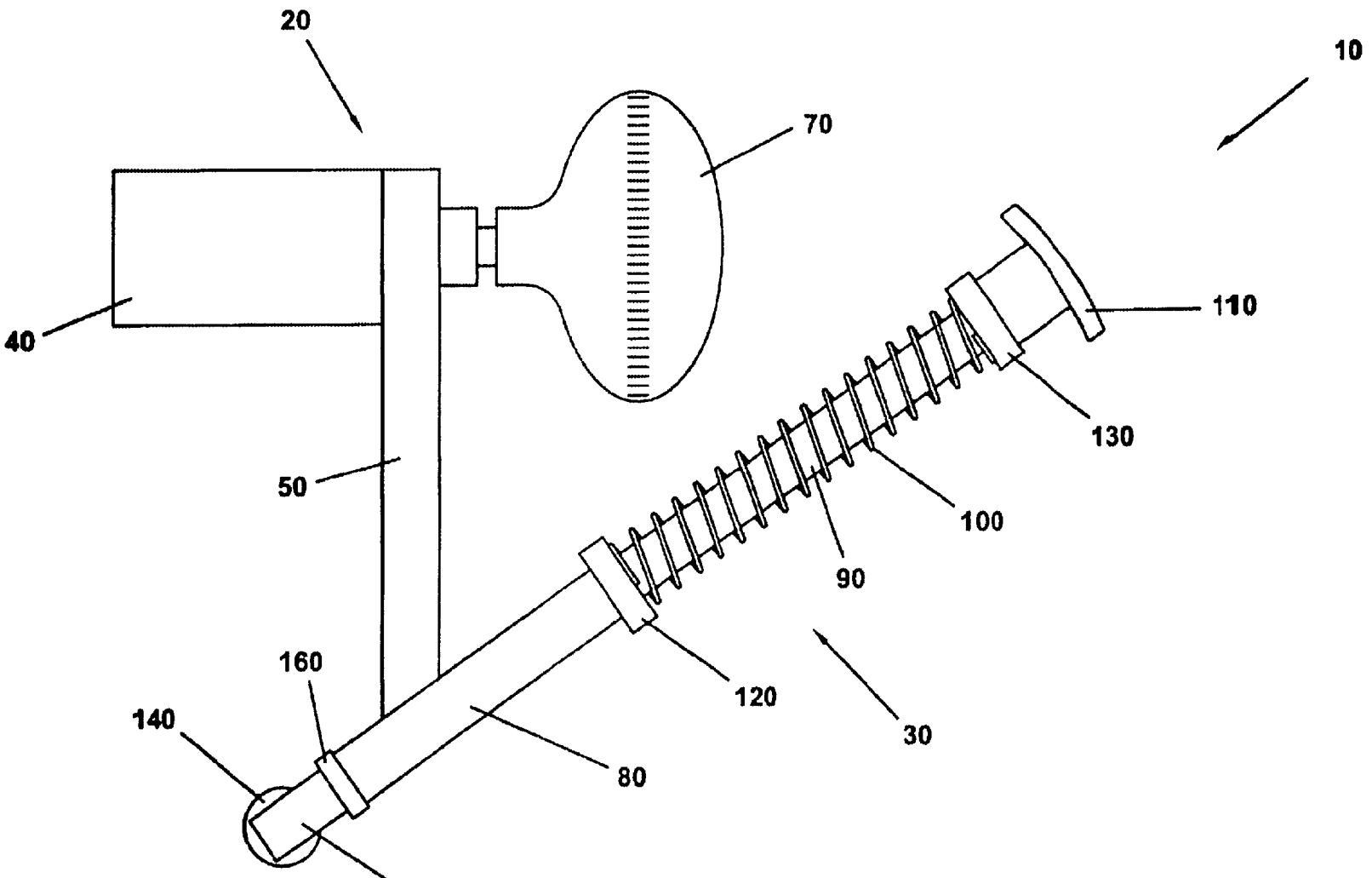
FIG. 2 is a bottom plan view of the device of FIG. 1.
Figure 3:
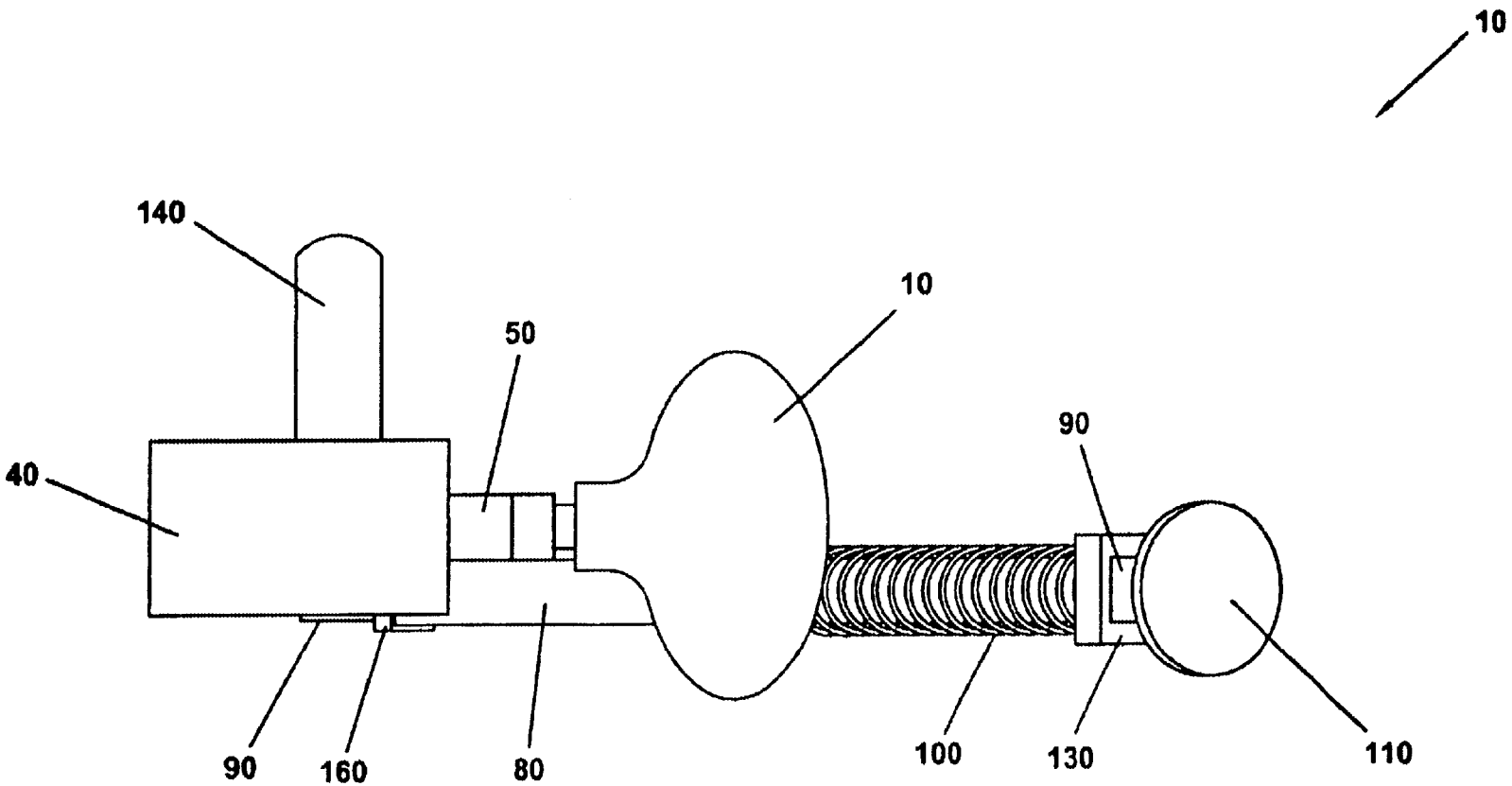
FIG. 3 is a front elevation view of the device of FIG. 1.
Figure 4:
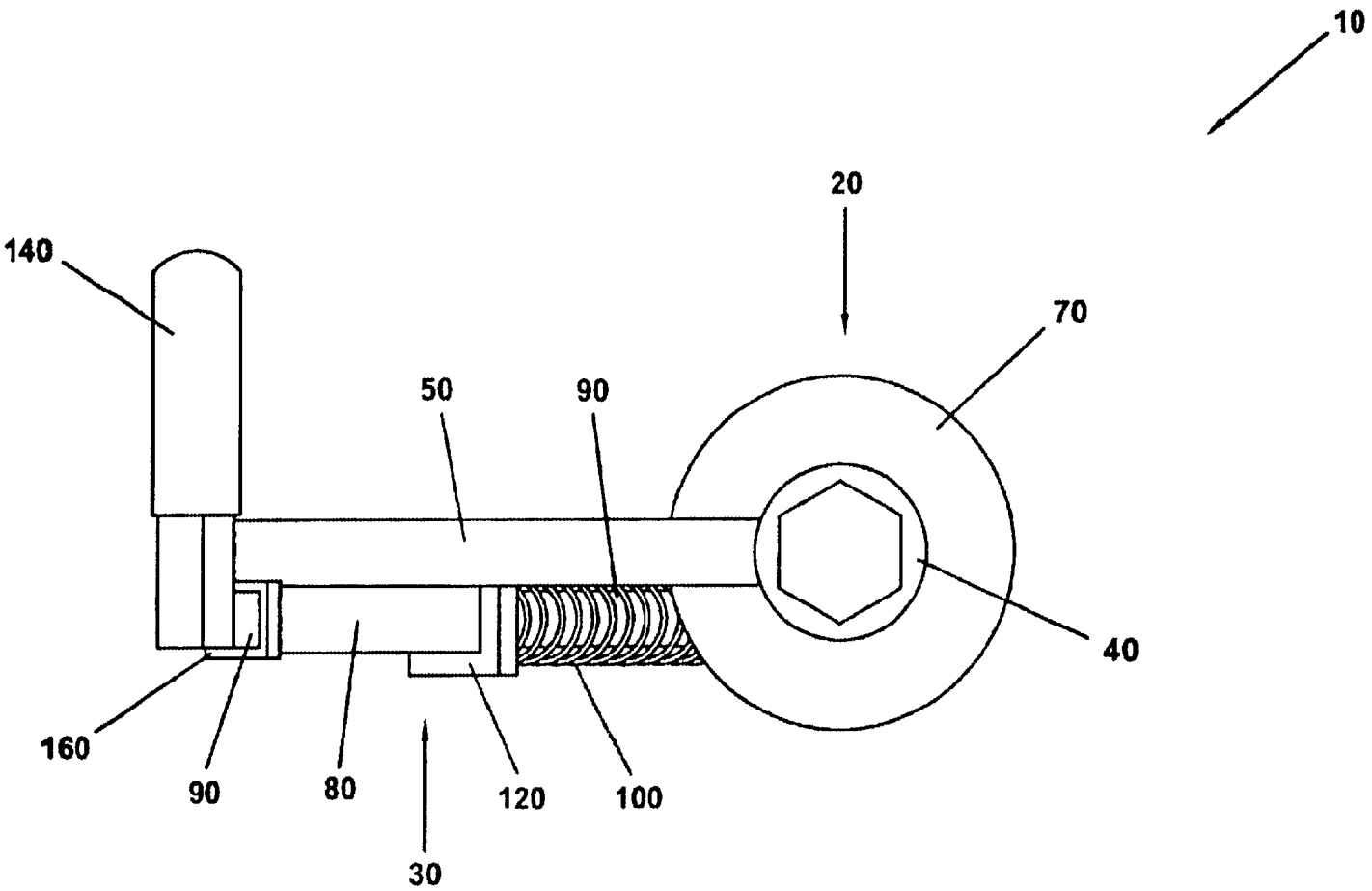
FIG. 4 is left side elevation view of the device of FIG. 1.
Figure 5:
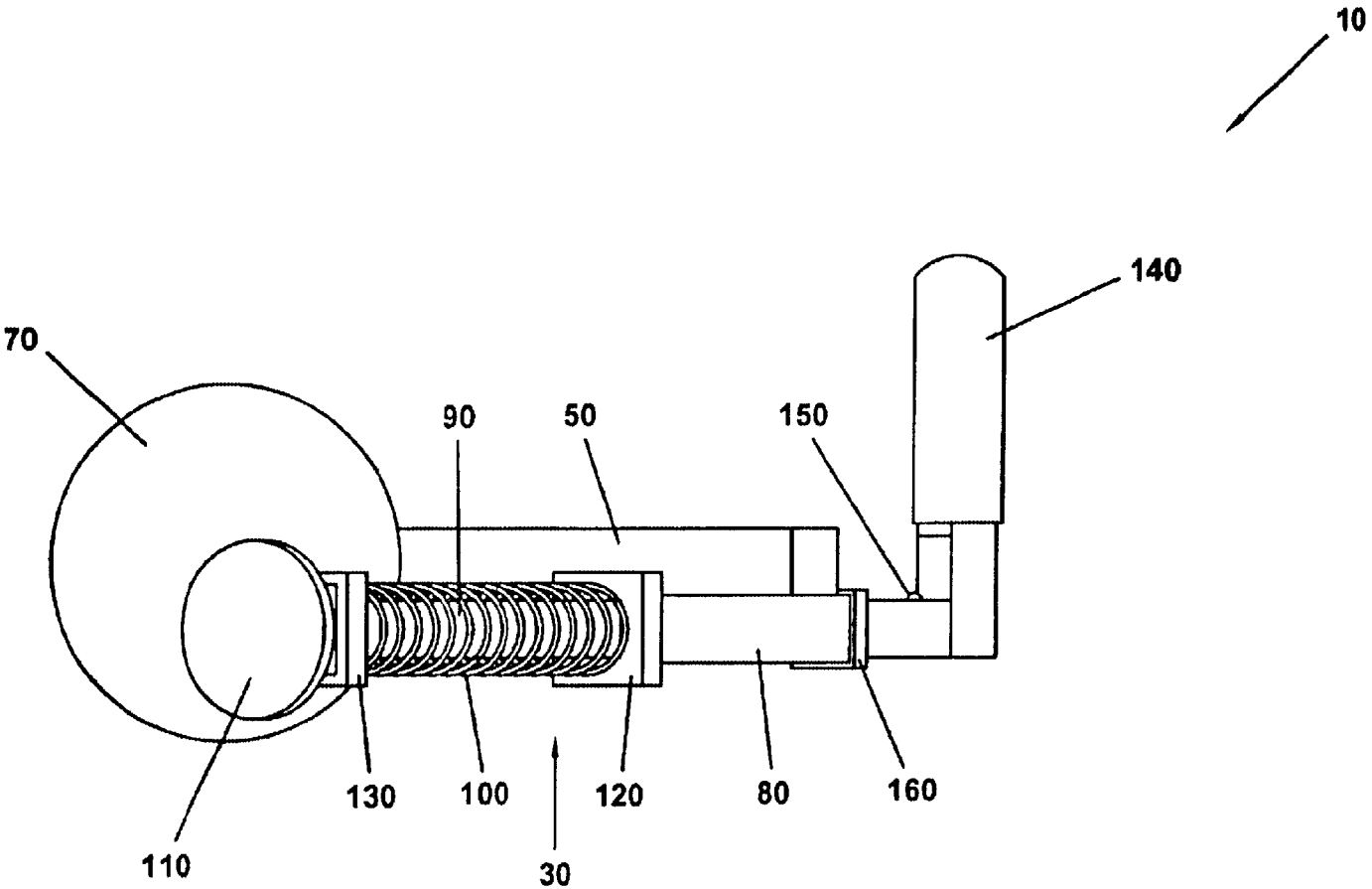
FIG. 5 is a right side elevation view of the device of FIG. 1.
Figure 6:
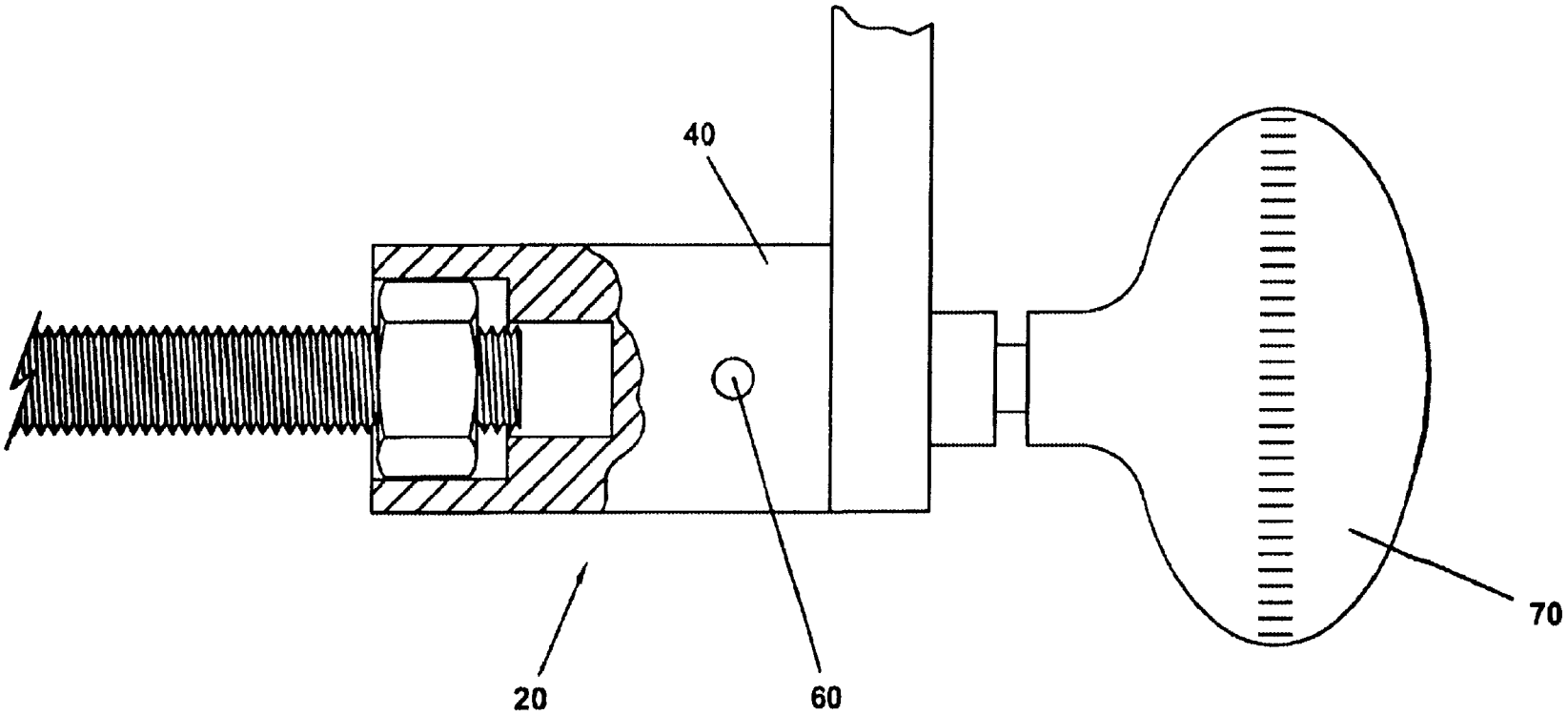
FIG. 6 is an enlarged view in partial cross-section, showing a portion of the device in operation.

One embodiment of a self-supporting retaining device according to the present invention can be seen by reference to FIGS. 1–5. As can be observed, the retaining device 10 consists primarily of a first portion 20, provided to engage and retain a bolt head or nut, to which is connected a second portion 30, provided to support and prevent rotation of the device by engaging an adjacent structure or feature. The first portion 20 is provided with a bolt head or nut retaining component 40, that is attached at or near a first end of a connecting member 50. The connecting member is shown here to be of substantially square shape, but other shapes are also possible. Preferably, the retaining component 40 consists of a socket. However, it is also possible that the retaining component may consist substantially of an open end or box wrench-type component (not shown). The retaining component 40 may be permanently attached to the connecting member 50, such as by welding. Alternatively, the retaining component 40 may be releasably attached to the connecting member 50 so that the retaining device 10 can be applied to bolt heads and nuts of various size. When the retaining component 40 is a socket, a socket retaining post (not shown) may be affixed to the connecting member 50 such that different sockets may be removably attached thereto. Socket retaining posts are commonly employed on ratcheting socket wrenches and similar tools to provide for socket interchangeability. The socket retaining post may employ a spring-loaded ball 60 to assist in retention of the socket.

A handle, which in this particular embodiment comprises a knob 70, is preferably affixed to the connecting member 50 substantially opposite the retaining component 40. The knob 70 allows a user of the retaining device 10 to locate the retaining component 40 onto the bolt head or nut of the fastener assembly with which it will be employed. The knob 70 also allows the user thereof to remove the retaining device 10 once tightening or loosening of the fastener assembly is complete. Other types of handles may also be utilized, so long as the handle allows the user to properly manipulate the retaining device 10.

The second portion 30 acts as a securing device and is provided to engage a structure near the location of the fastener assembly, thereby securing the retaining device 10 to the bolt head or nut and preventing rotation of the device while the bolt head or nut on the opposite end of the fastener assembly is tightened or loosened. The second portion 30, preferably has an outer guideway 80 through which passes a securing member 90. The securing member 90 and the guideway 80 are preferably arranged in a substantially concentric relationship, such that the securing member is slidably disposed through the guideway. The securing member 90 and the guideway 80 may be of a variety of shapes, such as the substantially square shape shown in FIGS. 1–5. Preferably, however, rotation of the securing member 90 within the guideway 80 is either prevented by the relative shape of each component, or is prevented by an additional structure or structures attached to one or both of the guideway and securing member.

Preferably, a biasing means is provided to encourage the securing member 90 to remain in either an extended or retracted position. In the embodiment shown in FIGS. 1–5, the securing member 90 is biased toward a retracted position. In this particular embodiment of the present invention, the biasing means comprises a spring 100, although other means may also be employed. Such other biasing means may include, for example, different types of springs, compressed gas or compressed hydraulic fluid within the guideway 80 acting against a portion of the securing member 90, elastic members, or magnetic or various other suitable devices. In this particular embodiment of the device 10, the spring 100 is disposed between an actuating knob 110 located at a first end of the securing member 90, and a spring stop 120 located at a first end of the guideway 80. Although not essential to the device, the actuating knob 110 makes it easier for a user thereof to extend the securing member 90. The spring stop 120 acts to retain the position of one end of the spring 100, and may also act to limit the travel of the securing member 90 through the guideway 80. A second spring stop 130 may be disposed at the base of the actuating knob 110, or the actuating knob itself may act as a second spring stop.

An engagement element 140, such as the post shown, is preferably provided at the second end of the securing member 90. The engagement element 140 allows the securing member 90 to engage a structure or other component in the vicinity of the fastener assembly onto which the device 10 is installed. The engagement element 140 is not to be limited to the post shown in FIGS. 1–5, but rather may be of a multitude of sizes and shapes depending on the particular application in which the device 10 is employed. It is contemplated that in certain embodiments, the engagement element 140 may be adjustable in both length and direction in order to provide for maximum compatibility. It is also contemplated that a variety of interchangeable engagement elements may be utilized as needed, and removably attached to the second end of the securing member 90, such as by means of a socket retaining post (as described above) or a similar retaining device.

A release element 150 may also be located near the second end of the securing member 90. The release element 150 is provided to facilitate disengagement of the securing member 90 from the neighboring structure with which it is engaged. During tightening of a fastener assembly to which the retaining device 10 is installed, the torque exerted on the fastener assembly will often force a portion of the securing member 90 into forceful contact against the structure with which it is engaged. This force can make it difficult to slidably move the securing member 90 during removal of the retaining device 10, as a portion of the surface of the securing member and the structure with which it is engaged may experience significant frictional resistance. The release element 150 is designed to minimize the contact areas between the securing member and the structure to which it is attached. In this particular embodiment, the release element 150 comprises a substantially spherical body, so that the contact area between the surface of the securing member and the structure to which it is engaged is minimized. Other shapes are also possible, however. It is also contemplated that low friction materials or coatings may be employed on the contacting surface(s) of the securing member 90 and/or the contacting surface of the release element 150 to further facilitate disengagement of the securing element from the structure. Although not essential, a retracting stop 160 may be located at the second end of the guideway 80 to limit the retracted position of the securing member 90.

Figure 7:
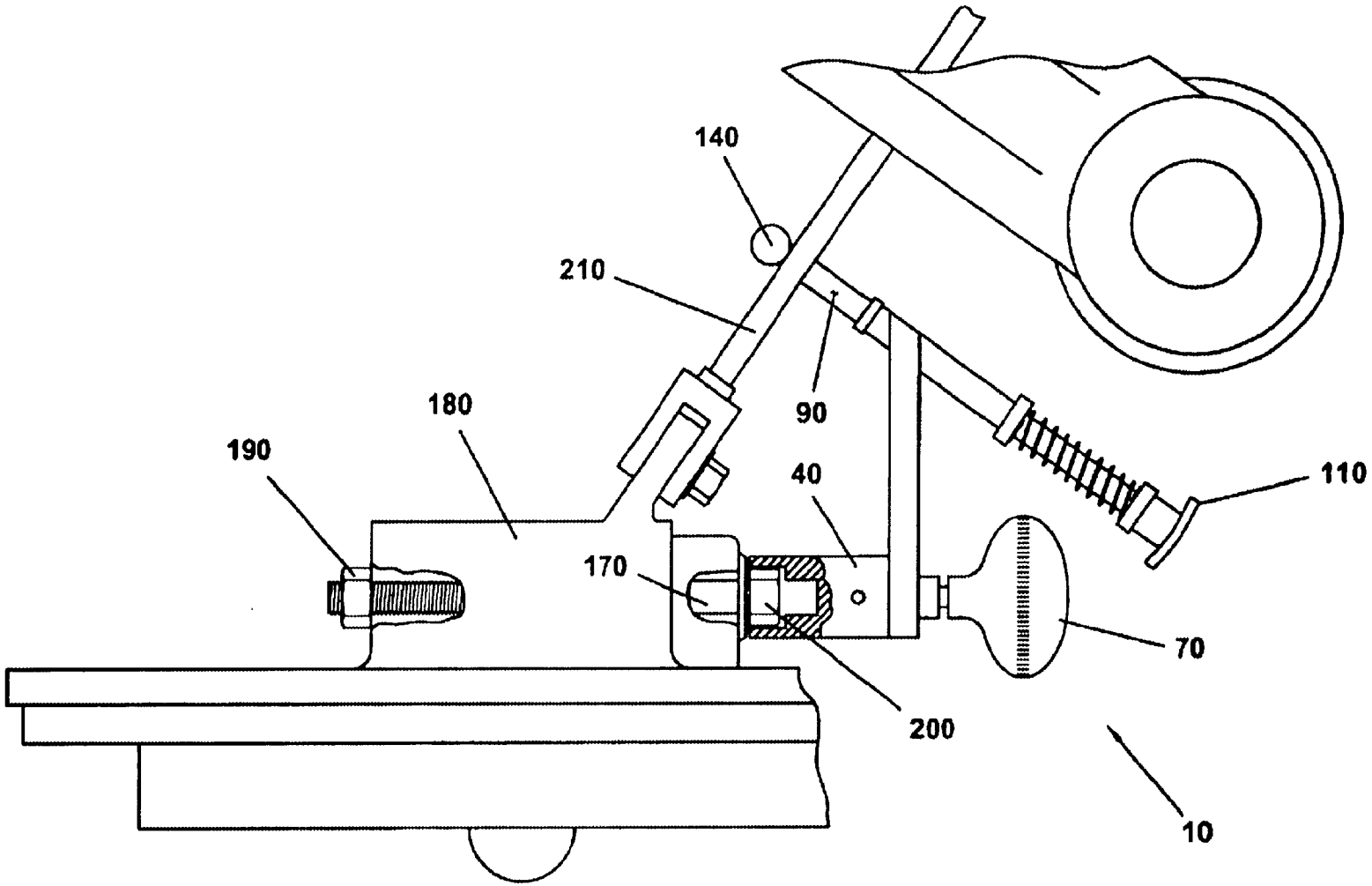
FIG. 7 shows the device of FIG. 1 engaged with a neighboring structure during use.

As can be observed by reference to FIG. 7, the retaining device 10 of the present invention is designed to be applied to a threaded fastener assembly after the body 170 of the fastener assembly has been inserted through the component 180 or components that it is to secure. This particular embodiment of the retaining device 10 is designed to be installed specifically to a nut or bolt head of such a threaded fastener assembly. For example, in a securing (tightening) operation, the fastener body is inserted through the component 180 to be secured, and a nut 190 is applied to the threaded end thereof. The retaining device 10 is then installed to the head 200 of the fastener body while the fastener assembly remains in a substantially loose position, such that the entire fastener assembly may be rotated with the retaining device. The retaining device 10 is preferably installed by grasping the handle 70 and placing the retaining component 40 into mating engagement with the bolt head 200. Preferably, the securing member 90 is then extended from the guideway 80 by depressing the actuating knob 110 and is temporarily maintained in such a position by the user. The retaining device 10 may then be rotated, along with the entire fastener assembly, until the securing member 90 is properly positioned with respect to a neighboring structure 210 with which it will become engaged. Upon allowing the securing member 90 to return toward its retracted position, the engagement element 140 attached to the securing member will maintain the securing member in contact with the neighboring structure 210, whereby the force of the biasing means 100 will support the retaining device 10 to allow it to remain in a position mated to the bolt head 200. The user may then move to a position where the opposite side of the fastener may be properly operated upon, whereupon the user will have both hands free to tighten the nut 190 by whatever means are appropriate. The retaining device 10 will maintain its position, and will retain the head 200 and integral fastener body so that the nut 190 may be tightened by the user. Upon completion of the tightening operation, the securing member 90 is extended by the user, thereby providing sufficient clearance so that the retaining component 40 can be withdrawn from the bolt head 200 and the retaining device 10 can be removed. It should be understood that while use of the retaining device is described above with the device applied to the bolt head 200 of a threaded fastener assembly, the device could also be installed on the nut 190 portion of the fastener assembly with equally acceptable results. It should also be appreciated that use of the device is not limited to the tightening of a fastener assembly, as the device can also be used to retain the position of a bolt head or nut during a loosening operation.

Certain embodiments of the present invention are described in detail above. However, it should be realized that other embodiments are also possible. For example, the size and orientation of each portion of the device may be constructed to comport with the conditions prevalent at a particular application. The securing device portion of the device may have a retractable, rather than an extendable securing member, or the securing member may be fixed. Thus, the scope of the invention is not to be considered limited by the above disclosure, and modifications are possible without departing from the spirit of the invention as evidenced by the following claims.

What is claimed is:

1. A self-supporting fastener retention device for use on a threaded fastener assembly, comprising:

a first portion having a retaining component for mating to a head or nut of a fastener assembly that is located in a component to be secured;

a second portion connected to said first portion, said second portion having a linearly extendable securing member for engaging a structure that neighbors said component to be secured, after said retaining component is mated to said head or nut; and an engaging element extending from one end of said securing member for releasably coupling said securing member to said neighboring structure;

whereby a mated position of said device to said head or nut is maintained by engagement of said securing member with said neighboring structure, thereby allowing said retaining component to retain said head or nut without assistance from a user of said device.

2. The self-supporting fastener retention device of claim 1, wherein said retaining component is a socket.

3. The self-supporting fastener retention device of claim 2, wherein said socket is interchangeable with other sockets of like or varying size.

4. The self-supporting fastener retention device of claim 1, wherein said securing member is movable between an extended and retracted position.

5. The self-supporting fastener retention device of claim 4, further comprising a biasing means for encouraging said securing member toward either a retracted or extended position.

6. The self-supporting fastener retention device of claim 5, wherein engagement of said securing member and said neighboring structure is maintained by said biasing means.

7. The self-supporting fastener retention device of claim 1, further comprising a handle for facilitating the mating of said retaining component with said head or said nut of said fastener assembly.

8. The self-supporting fastener retention device of claim 1, further comprising a component for facilitating extension or retraction of said securing member by a user of said device.

9. A self-supporting fastener retention device for use on a threaded fastener assembly having a head and a nut, comprising:

a connecting member;

a retaining component attached near a first end of said connecting member for retaining said head or nut;

a handle attached near said first end of said connecting member for manipulating said retaining component;

a securing device having a linearly extendable arm attached near a second end of said connecting member, said securing device for engaging a structure neighboring the location of said threaded fastener assembly after said retaining component is placed into mating contact with said head or nut; and a biasing means for encouraging said extendable arm toward a substantially retracted or extended position;

whereby, without assistance from a user of said device, said retaining component retains said head or nut during tightening or loosening of the fastener assembly.

10. The self-supporting fastener retention device of claim 9, wherein said retaining component is a socket.

11. The self-supporting fastener retention device of claim 10, wherein said socket is interchangeable with other sockets of like or varying size.

12. The self-supporting fastener retention device of claim 9, wherein engagement of said securing device with said neighboring structure is maintained by said biasing means.

13. The self-supporting fastener retention device of claim 9, further comprising a component for facilitating the movement of said extendable arm by a user of said device.

14. The self-supporting fastener retention device of claim 9, further comprising an engaging element extending from one end of said extendable arm for releasably coupling said securing device to said neighboring structure.

15. The self-supporting fastener retention device of claim 9, further comprising a release element protruding from a contacting surface of said extendable arm, said release element provided to facilitate disengagement of said securing device from said neighboring structure.

16. A method of temporarily securing a head or nut of a threaded fastener assembly that is located in a component to be secured, comprising:

providing a device having a first portion for mating to said head or nut on one end of said fastener assembly, and a second portion connected to said first portion, said second portion for engaging a structure that neighbors the component to be secured;

installing said first portion of said device to said head or said nut of said fastener assembly;

extending an extendable section of said second portion of said device;

rotating said device and said fastener assembly until said extendable section of said second portion is properly oriented to engage said neighboring structure;

releasing said extendable section so that said second portion of said device becomes engaged with said neighboring structure; and tightening or loosening said fastener assembly by rotating a head or nut located on the end of said fastener assembly opposite that installed to said device;

whereby the position of said device will be maintained and said first portion of said device will retain said head or nut during the tightening or loosening operation.

17. The method of claim 16, further comprising providing a biasing means for encouraging said extendable section toward a retracted position.

18. The method of claim 16, further comprising providing a release element for facilitating the slidable disengagement of said extendable section from said neighboring structure.

19. The method of claim 16, further comprising, after tightening or loosening said fastener assembly, extending said extendable section, rotating said device so that said second portion is disengaged from said neighboring structure, and removing said first portion of said device from said head or said nut of said fastener assembly.

* * * * *